US005090689A

United States Patent [19]

Petz

[11] Patent Number: 5,090,689

[45] Date of Patent: Feb. 25, 1992

[54] SOLAR CAROUSEL

[76] Inventor: Peter Petz, Siedlungsstrasse 44, 8891 Sulzbach-Aichach, Fed. Rep. of Germany

[21] Appl. No.: 635,935

[22] Filed: Dec. 28, 1990

[30] Foreign Application Priority Data

May 31, 1990 [DE] Fed. Rep. of Germany ... 9006175[U]

[51] Int. Cl.[5] ..... A63G 1/00

[52] U.S. Cl. ..... 272/29; 272/40; 272/42; 272/44

[58] Field of Search ..... 272/28 R, 38, 39, 40, 272/42, 44, 47, 29

[56] References Cited

U.S. PATENT DOCUMENTS 1,271,892 7/1918 Habeshaw ..... 272/42

*Primary Examiner*—Richard E. Chilcot, Jr.
*Attorney, Agent, or Firm*—Oliff & Berridge

[57] ABSTRACT

A carousel powered by an arrangement of photoelectric solar panels is driven by an electric motor, which is connected through a battery to an arrangement of solar cells located on the roof of the carousel. Also connected to the battery, in parallel with the motor, are a number of decorative bulbs, to prevent overcharging of the battery. The solar panels are hinged and are placed on the roof of the carousel with one part of the panel horizontal to the ground, and the other part angled upwards, to maximize the capture of solar energy regardless of the location of the sun in the sky. Additionally, the carousel figures are removable and the roof and base of the carousel are hinged, so that the carousel can be folded into a transport position.

12 Claims, 6 Drawing Sheets

SOLAR CAROUSEL

BACKGROUND OF THE INVENTION

The invention relates to a carousel driven by an electric motor provided with electric energy generated by photoelectric solar panels located on the roof of the carousel and is preferably used in small carousels.

SUMMARY OF THE INVENTION

Carousels are usually driven by electric motors usually supplied from the public power network with electric current. At smaller carnival events on lots set up temporarily, such as fields for example, the question of a power supply can become a problem when no suitable power connection is available sufficiently close.

A carousel according to the invention offers a welcome alternative to the conventional power supply in this case. It is powered by solar energy. The solar cells located on the roof of the carousel convert light energy into electrical energy which is used to drive the carousel.

A carousel of this kind is particularly attractive to the public because it seems to rotate by itself. In addition, a carousel powered by solar energy is an example of how solar energy can be used for previously unconventional purposes and is therefore a special attraction on fairgrounds.

Additional details of the carousel design include an arrangement of the solar cells which allow a reduction of the carousel width when transporting the carousel either in a state in which it is loaded on a transport vehicle or provided with its own chassis, by folding the floor platform and roof segments as well as the solar cell arrangements to a width which is suitable or acceptable for highway transportation, without the carousel having to be completely disassembled. Only the carousel horses or other figures will have to be removed.

One embodiment of the invention is described briefly below with reference to the attached drawings.

BRIEF DESCRIPTION OF THE DRAWINGS

FIG. 3 is a top view of a preferred embodiment for a carousel with three horses or the like;

FIG. 4 is a top view of a preferred arrangement similar to FIG. 3 but for a carousel with four horses or the like;

DETAILED DESCRIPTION OF THE PREFERRED EMBODIMENTS

Figure 1:
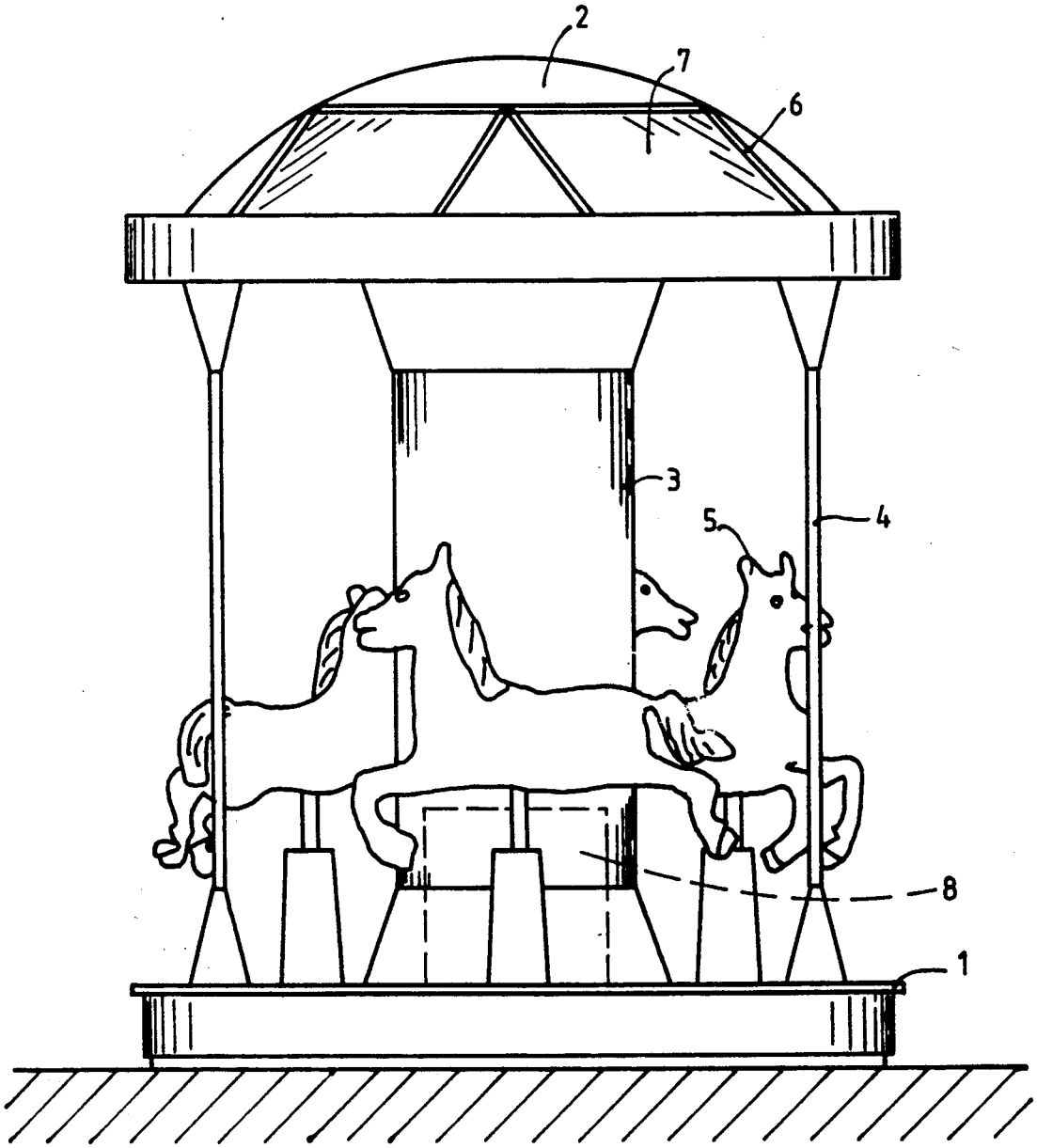
FIG. 1 is a front view of a carousel according to the invention.
Figure 2:
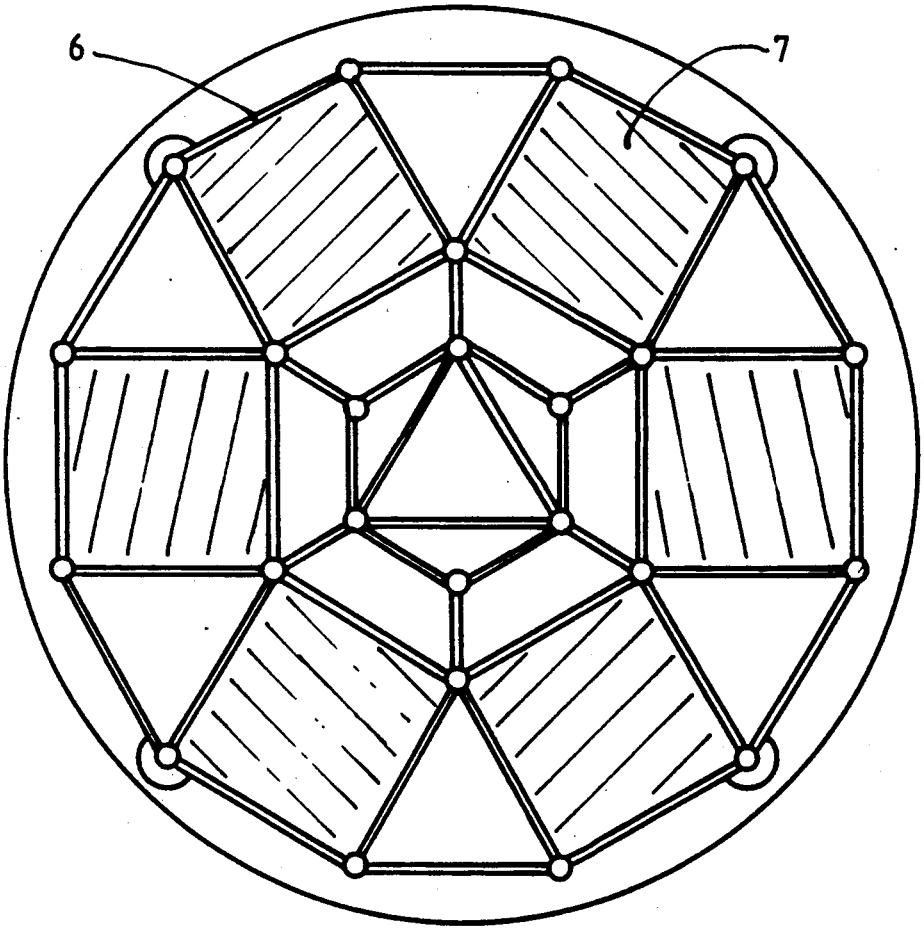
FIG. 2 is a top view of the carousel and the arrangement of the solar cells on the roof.
Figure 5:
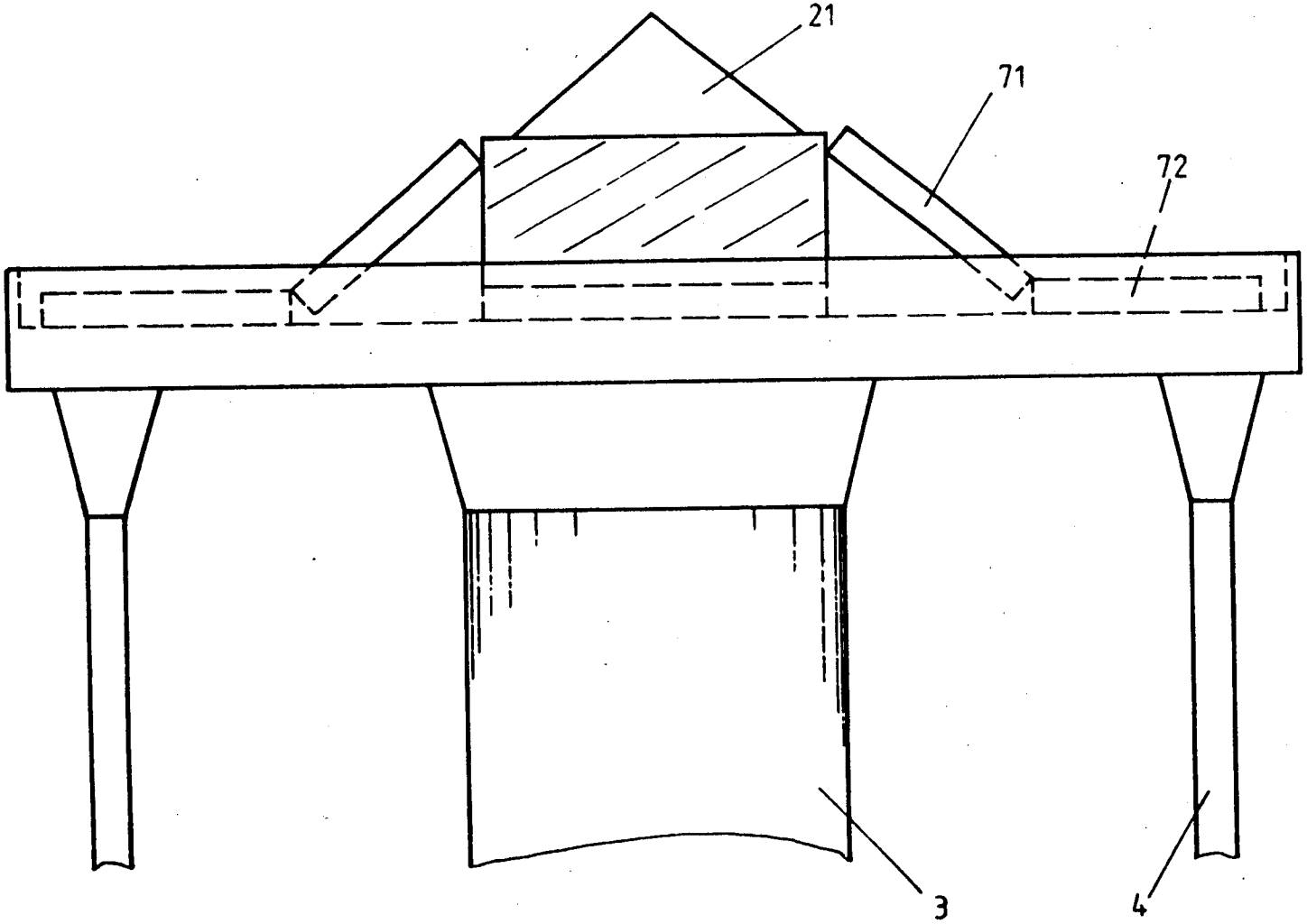
FIG. 5 is a side view of the roof design shown in top view of FIG. 4.

The carousel shown schematically in FIGS. 1 and 2 has a platform 1 and a roof 2 connected by a central column 3 and reinforced by rods 4 arranged around the circumference. On platform 1, FIGS. 5, horses for example, are mounted, on which the passengers sit when the carousel is running. The carousel rotates as a whole, in other words platform 1, roof 2, and column 3 as well as rods 4 are all parts of the rotating design.

Roof 2 has a dome-shaped upwardly convex form and a frame construction made of bars 6. Solar cell arrangement 7 is mounted between bars 6, and can be in the form of rectangular panel elements. Advantageously they can be simply hung on the frame structure, in other words provided with latching or quick-locking mechanisms and plug connections for example for the electrical hookup. They can be removed and taken down for shipment. The dome-shaped form of the roof causes the solar cell arrangements 7 to slope upward and therefore to be illuminated approximately uniformly when the sun is at different heights in the sky.

The electrical energy supplied by solar cell arrangements 7 is fed to the electric motor which is located invisibly with the covering of column 3 and drives the carousel through a suitable drive. The solar cell arrangements 7 feed the electric motor through an electric battery 8 which serves as a buffer storage device, said battery also being located inside the covering of central column 3 in which the electrical regulating system, etc. is also contained. Additional electrical consumers in the form of decorative bulbs can be provided as an overload protection for the battery, said bulbs being located for example in the usual fashion in the fringe around the edge of the roof (not shown) and automatically turned on by a regulator when the battery has reached a certain fully loaded state.

Figure 3:
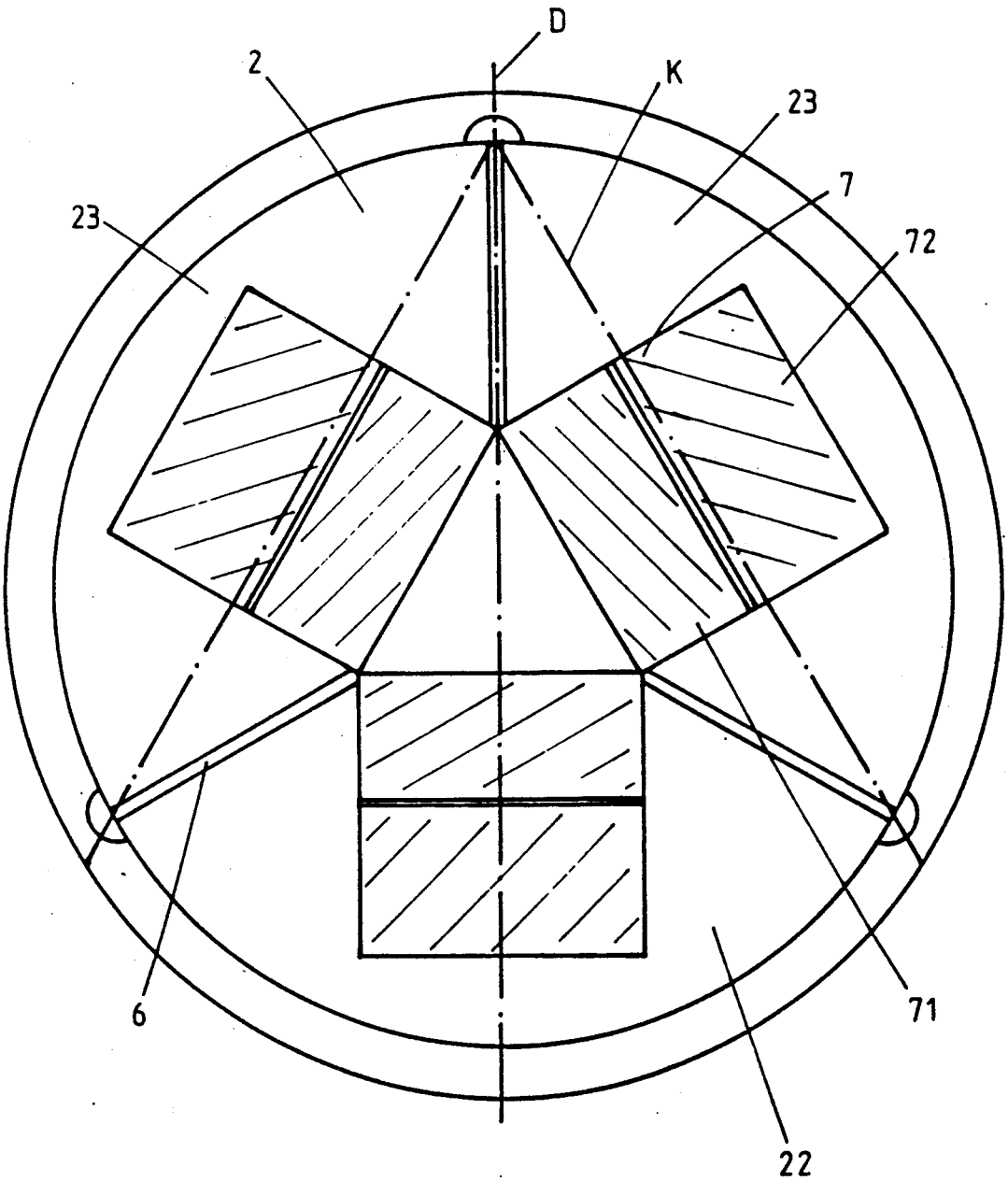
Figure 4:
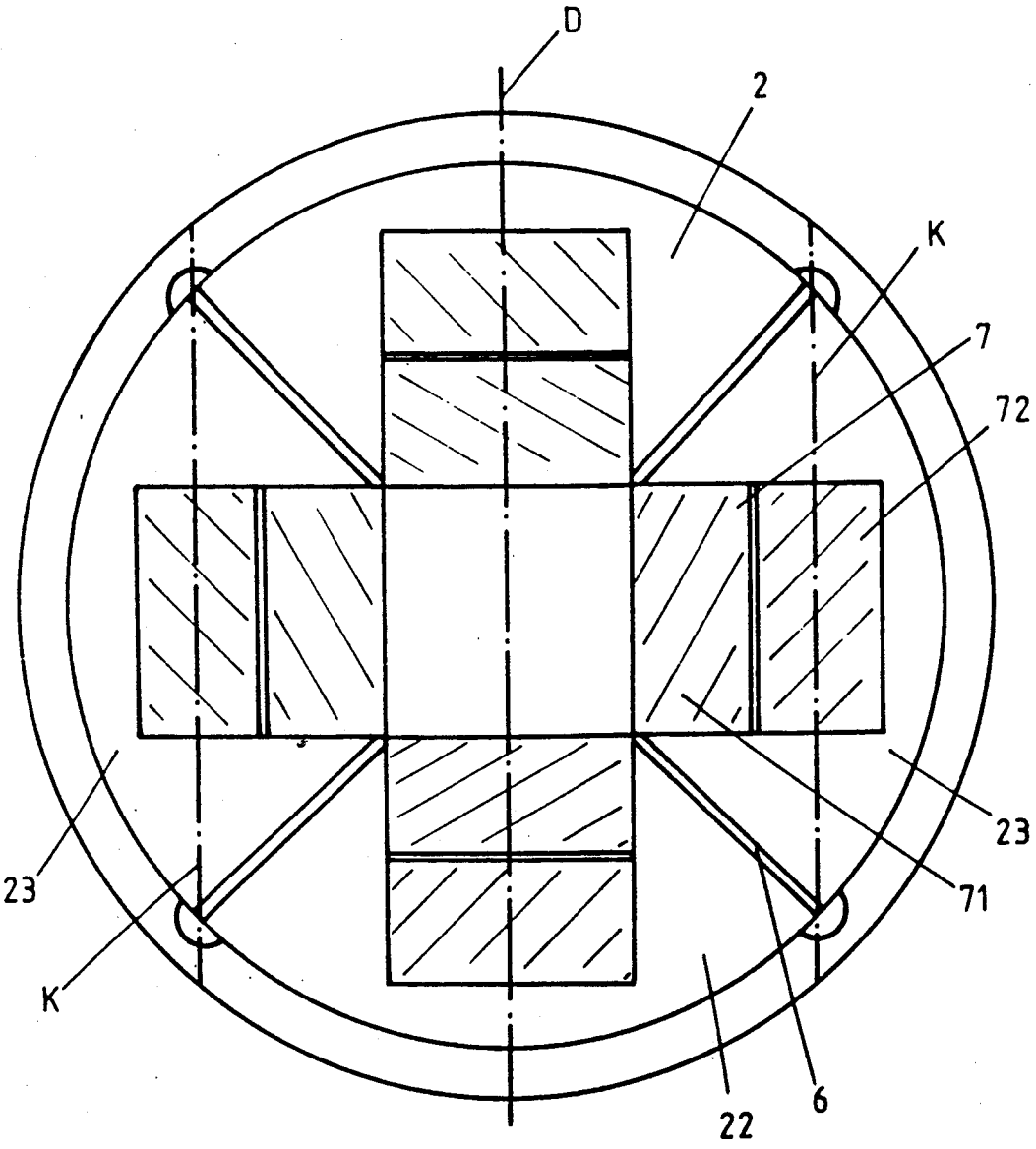

FIGS. 3 and 4 show top views similar to FIG. 2 on preferred additional embodiments of the roof design with the solar cells, especially on a readily transportable carousel which can be transported on the road without taking down the entire carousel and can also preferably be mounted directly on a chassis of its own 10 (own FIG. 6) permanently. It is then necessary to reduce the width of the carousel for transportation to a size the meets highway traffic guidelines to that the carousel can simply be hitched as a trailer to a towing vehicle or, if it does not have its own chassis, can be loaded onto a flatbed trailer.

In the embodiments shown in FIGS. 3 and 4, three to four solar cell arrangements 7 are provided which are arranged in a rotationally symmetrical pattern and each consists of two panel segments 71 and 72, namely a radially inward panel segment 71 and a radially outward panel segment 72. The view in FIG. 5, which refers to the embodiment according to FIG. 4, shows that the radially inward panel segment 71 is always mounted so that it slopes upward to a roughly pyramidal carousel roof point 51, while the radially outward panel segment 72 lies flush against a flat out roof edge area.

Figure 6:
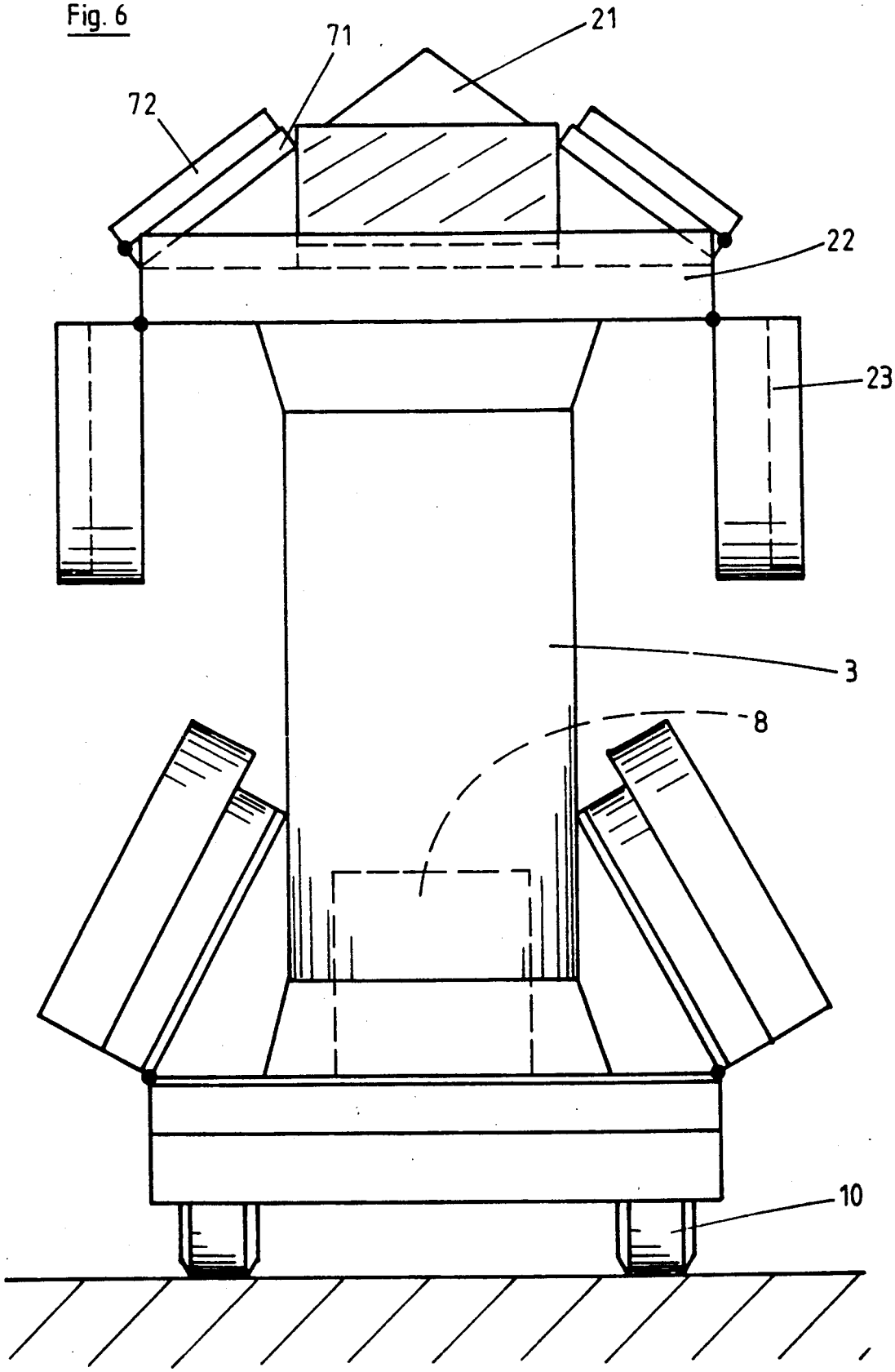
FIG. 6 is a view of a carousel with the roof design according to FIGS. 4 and 5 in the transportation position.

FIGS. 3 and 4 show a diagonal D that runs through the carousel which runs parallel to the direction of travel when the carousel is in the transportation position. Of the solar cell arrangements 7, in FIGS. 3 and 4 the two solar cells located on either side of diagonal D are designed so that outer panel segment 72 in each case folds back onto inner panel segment 71 for transportation in other words the respective solar cell arrangement 7 can be practically folded up. This is shown in FIG. 6, which shows a view of a carousel according to FIG. 4 in the transportation position. In addition, carousel roof 2 in the embodiments shown in FIGS. 3 and 4 is designed so that in each case it is divided along the dot-dashed folding axis K on either side of diagonal D, in other words consists of a main part 22 that contains diagonal D, on which two lateral segments 23 are articulated to fold around the respective folding axis K. As regards roof design, the floor platform of the carousel can be provided with foldable platform segments 13 on either side of diagonal D which are articulated to main platform part 12.

FIG. 6 shows the carousel in the top view of FIG. 4 in the transportation position, with the foldable platform segments 13 folded upward, foldable roof segments 23 folded downward, and outer panel segments 72 of the solar cell arrangements 7 folded inward onto inner panel segments 71. Depending on the design features or requirements, of course, foldable roof segments 23 can also be folded upward.

I claim:

1. A carousel driven by an electric drive motor and provided with a roof comprising a supporting structure to receive a plurality of solar cell arrangements connected electrically with the drive motor.

2. The carousel according to claim 1 wherein the solar cell arrangements are connected electrically to a battery as a buffer storage, the battery connected to the drive motor and to a plurality of decorative bulbs mounted on the carousel as additional electric consumers wherein the bulbs are turned on automatically by electrical switching means when a predetermined load state of the battery is reached, for providing overload protection.

3. The carousel according to claim 1 wherein the solar cell arrangements have the form of roughly rectangular panel elements and are arranged in a circle on the roof.

4. The carousel according to claim 1 wherein the support structure comprises a plurality of bars, and wherein the solar cell arrangements are fastened to the bars.

5. The carousel according to claim 1 by wherein the solar cell arrangements are detachably secured to the support structure.

6. The carousel according to claim 1 wherein the roof is formed as an integral part of a rotating structure of the carousel.

7. The carousel according to claim 1 further comprising at least two lower segments of a carousel platform, wherein the segments are located on either side of a first predetermined diagonal of the carousel and hingedly mounted to the carousel platform, such that the lower segments are foldable into a roughly vertical position for transportation of the carousel; and at least two upper segments of the carousel roof, wherein the upper segments are located on both sides of a second diagonal and hingedly fastened to a remainder of the carousel roof such that the upper segments are foldable into one of a hanging down position and a pointing up position.

8. The carousel according to claim 7 wherein the solar cell arrangements are located on both sides of the second diagonal and mounted such that the solar cell arrangements are foldable at least partially onto the remainder of the carousel roof.

9. The carousel according to claim 8 wherein each solar cell arrangement comprises a radially inward panel segment and a radially outward panel segment hingedly connected thereto, wherein the radially outward panel segment is foldable onto the radially inward panel segment.

10. The carousel according to claim 9 comprising a normal operating position, wherein the inward panel segment is positioned at an angle to the horizontal and the outward panel segment is positioned approximately horizontally.

11. The carousel according to claim 8 wherein at least three solar cell arrangements are mounted in a radially symmetrical grouping on the carousel roof, with the radially inward edges of the solar cell arrangements abutting one another to form an equilateral polygon.

12. The carousel according to claim 7, wherein the carousel is mounted on a chassis.

* * * * *